US007490426B2

(12) United States Patent
Scarberry

(10) Patent No.: US 7,490,426 B2
(45) Date of Patent: Feb. 17, 2009

(54) DISPLAY SYSTEM AND METHOD OF USING SAME

(76) Inventor: Eugene Scarberry, 4373 Old William Penn Hwy., Murrysville, PA (US) 15668

( * ) Notice: Subject to any disclaimer, the term of this patent is extended or adjusted under 35 U.S.C. 154(b) by 158 days.

(21) Appl. No.: 11/537,752

(22) Filed: Oct. 2, 2006

(65) Prior Publication Data

US 2007/0094907 A1 May 3, 2007

Related U.S. Application Data

(60) Provisional application No. 60/722,582, filed on Sep. 30, 2005.

(51) Int. Cl.

| | |
|---|---|
| ***G09F 15/00*** | (2006.01) |
| ***E01F 9/00*** | (2006.01) |
| ***A47H 1/00*** | (2006.01) |
| ***A24F 15/00*** | (2006.01) |

(52) U.S. Cl. ..... 40/610; 40/624; 116/63 P; 160/24; 206/244; 206/236; 206/273

(58) Field of Classification Search ..... 40/610, 40/602, 736; 160/37, 24; 135/121, 134, 135/137, 148; 446/199; 116/63 P, 63 R; 206/748, 747, 745, 774

See application file for complete search history.

(56) References Cited

U.S. PATENT DOCUMENTS

| | | | | | |
|---|---|---|---|---|---|
| 2,387,790 | A * | 10/1945 | Williamson | ..... | 206/236 |
| 5,970,639 | A * | 10/1999 | Hui | ..... | 40/610 |
| 6,115,951 | A * | 9/2000 | Jing et al. | ..... | 40/610 |
| 6,686,711 | B2 * | 2/2004 | Rose et al. | ..... | 318/16 |
| 6,804,905 | B1 * | 10/2004 | Burger et al. | ..... | 40/610 |

* cited by examiner

*Primary Examiner*—Paul N Dickson
*Assistant Examiner*—Syed A Islam
(74) *Attorney, Agent, or Firm*—Blynn L. Shideler; Krisanne Shideler; BLK Law Group

(57) ABSTRACT

A display that that includes a base member and an inflatable frame coupled to the base member. The base member includes a plurality of sections that are moveable relative to one another between a stowed position and a deployed position. In the stowed position, the plurality of sections define a case for storing the inflatable frame in its collapsed state. In the deployed position, the plurality of sections define a base for the display system in the deployed position with the inflatable frame extending from the base to provide a display area of the display system.

10 Claims, 6 Drawing Sheets

DISPLAY SYSTEM AND METHOD OF USING SAME

RELATED APPLICATIONS

The present application claims the benefit of provisional application Ser. No. 60/722,582 filed Sep. 30, 2005, entitled "Display System and Method of Using Same."

BACKGROUND

1. Field of the Invention

The present invention pertains to a display system, and, in particular, to display system that easily transitions between a stowed position, in which the components of the display system are contained within a portable case, and a deployed position, in which the case forms a base for an inflatable frame that provides a display area.

2. Background Information

Hundreds, perhaps thousands, of trade shows and other exhibitions take place each day throughout the world. Each trade show includes numerous exhibitors attempting to display their goods or services. Each exhibitor typically includes some form of display for advertising their product, providing information to the attendees, etc. This display must be portable, so that it can be transported from one location to the next, and preferably, easy to assemble and disassemble by one person in a relatively short period of time.

Numerous conventional display systems have been developed to address these needs. However, few, if any, such display systems successfully address these problems. For example, it is known to provide a display system that includes a number of interlocking rigid members that are assembled much like a tent or scaffolding. One benefit of such systems is that the rigid frame members, when disassembled, can be stowed in a relatively small case, and when assembly provides a relatively rigid display structure. However, this type of display system is typically very difficult to assemble, because the user must connect the rigid frame members in the proper manner and the proper order. This often requires following detailed and complicated assembly instructions and also often requires additional tools. Furthermore, during the assembly process, and even in the fully assembled position, the display can be cumbersome and difficult for a small or frail person to manipulate or handle.

Another conventional display system is known in which a frame for a display area formed from inflatable members, such as tubes. This type of display system is beneficial in that it is relatively easy to erect and take down; merely requiring the user to inflate and deflate the tubular frame. However, conventional inflatable display systems are typically wobbly and unsteady, and require several containers to store the frame, the inflation device, and the display itself.

SUMMARY OF THE INVENTION

It is noted that, as used in this specification and the appended claims, the singular forms "a," "an," and "the" include plural referents unless expressly and unequivocally limited to one referent. For the purposes of this specification, unless otherwise indicated, all numbers expressing any parameters used in the specification and claims are to be understood as being modified in all instances by the term "about." All numerical ranges herein include all numerical values and ranges of all numerical values within the recited numerical ranges.

The various embodiments and examples of the present invention as presented herein are understood to be illustrative of the present invention and not restrictive thereof and are non-limiting with respect to the scope of the invention.

Accordingly, it is an object of the present invention to provide a display system that overcomes the shortcomings of conventional display systems. This object is achieved according to one embodiment of the present invention by providing a display system that includes a base member comprising a plurality of sections that are moveable relative to one another between a stowed position and a deployed position. The plurality of sections define a case in the stowed position, and define a base for the display system in the deployed position. The inflatable frame is coupled to the base member and collapses to a stowed position in which is entirely contained in the case. Conversely, the frame is also inflatable to a deployed position in which it extends from the base to provide a display area for the display system.

It is a further object of the present invention to provide a method of deploying the display system of the present invention, as well as a method of stowing such a display system.

These and other objects, features and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

FIG. 10 is a perspective view of the display system of FIG. 9 illustrating the base member in the fully deployed position and the inflatable frame extending there from;

DESCRIPTION OF THE PREFERRED EMBODIMENTS

Figure 1:
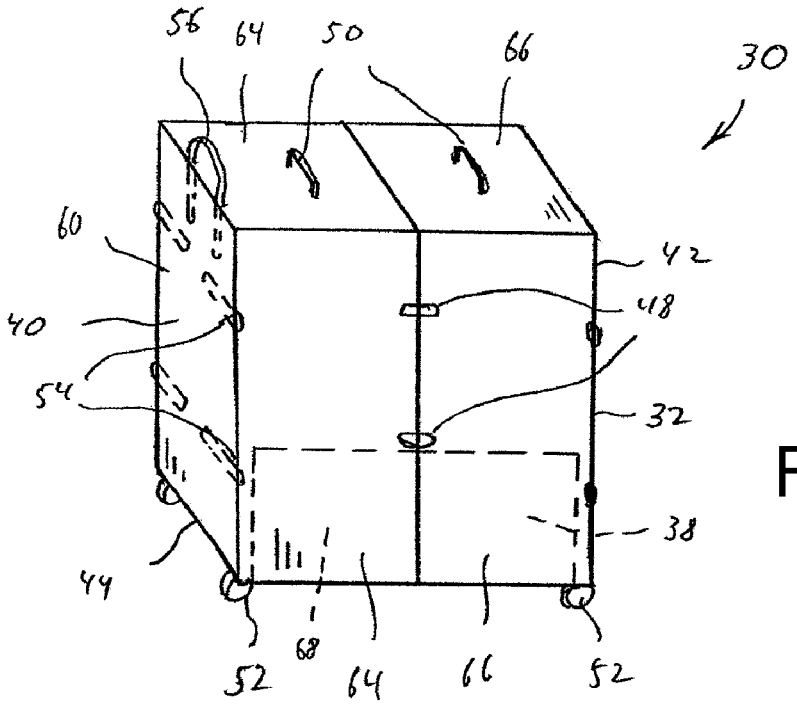
FIG. 1 is a perspective view of the display system of the present invention shown in the fully stowed position.
Figure 2:
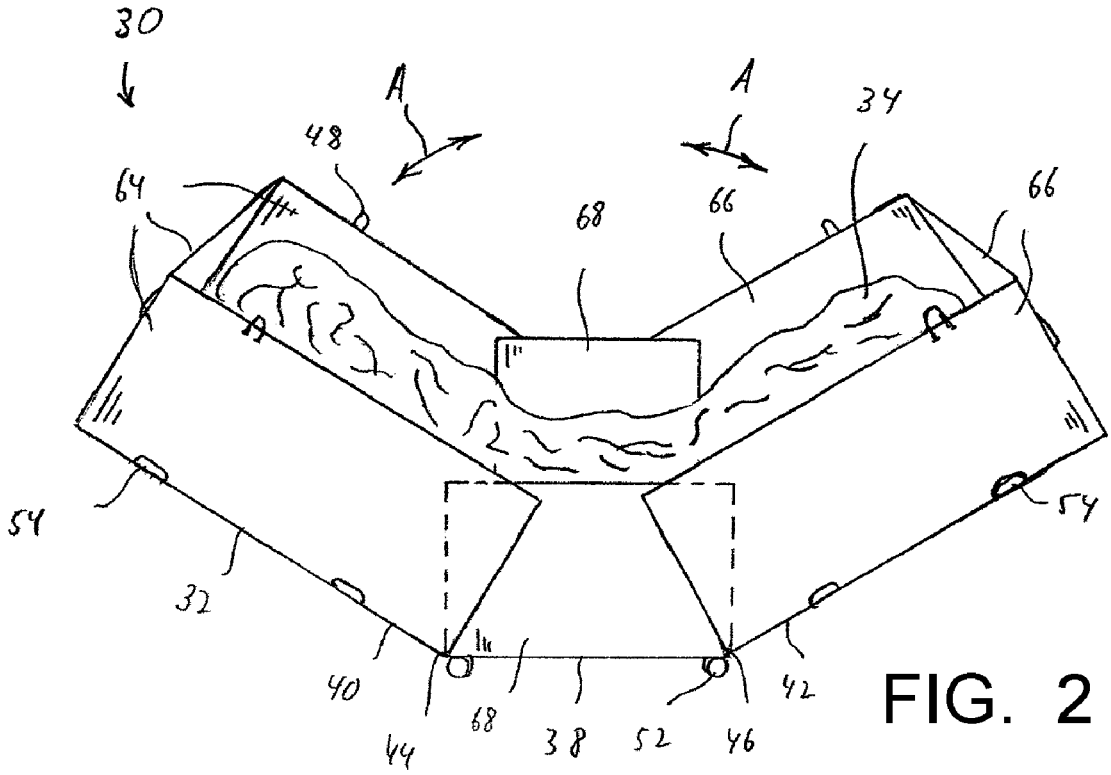
FIG. 2 is a perspective view of the display system of FIG. 1 illustrating a stage in the transition of the display system between the deployed and the stowed positions.

FIGS. 1-5 illustrate an exemplary embodiment of a self-contained display system 30 according to the principles of the present invention. Display system 30 includes a base member 32 and an inflatable frame 34 attached thereto. Base member 32 transitions between a stowed position shown in FIG. 1 and a deployed position shown in FIGS. 3 and 5. FIG. 2 illustrates a stage in the transition of the display system 30 between the deployed position and the stowed position.

In the stowed position, base member 32 forms a case that contains the inflatable frame 34. In the deployed position, the base member 32 serves as a base for the display system 30 with the inflatable frame 34 extending there from. Inflatable frame 34 collapses to a stowed position so as to be entirely contained in the case, and inflates to a deployed position so as to extend from the base member 32, thereby providing a display area 36 for display system 30.

Figure 3:
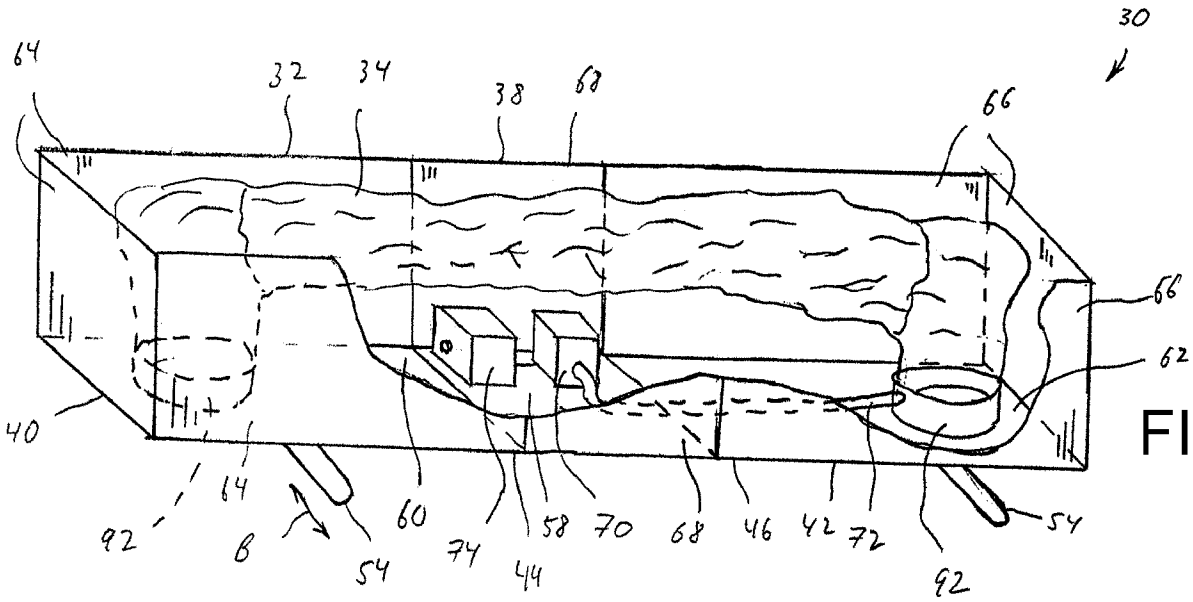
FIG. 3 is a perspective view of the display system of FIG. 1 illustrating the base member in the fully deployed position and the inflatable frame in the fully collapsed position.

In the embodiment shown in FIGS. 1-3 and 5, base member 32 includes a center section 38, a first section 40 and a second section 42. More specifically, a first end 44 of first section 40 is coupled in a manner to allow rotation (hereinafter "rotateably coupled") to a first side of the center section, and a first end 46 of second section 42 is rotateably coupled to a second side of the center section. This configuration allows the first and second sections 40 and 42 to fold or rotate in a clam-shell manner, as indicated by arrows A in FIG. 2, between the stowed position (FIG. 1) and a deployed position (FIG. 3).

First section 40 and second section 42 are complementary in size and shape so that in the stowed position, the first section and the second section define opposing halves of the case. Latches 48 are provided for locking the first and sections in the closed or stowed position. Of course, the present invention contemplates engaging these two sections together using any conventional fastening technique. In addition, handles 50 are provided on one or both of the first and second sections, and castors 52(wheels) are provided on the center section 38 and/or either of the other sections 40 and 42 for ease in transporting the case. The present invention contemplates making handles 50 and/or wheels 52 removable or retractable so that are hidden from view when the base member 32 is deployed or do not hinder the operation of the display system 30.

Base member 32 preferably includes retractable legs 54 that extend and retract from one or more of the sections 38, 40 and 42 of the base member 32, as indicated by arrow B in FIG. 3. In the extended position, legs 52 enhance the stability of the base for the display system 30. While legs 52 are shown provided on first and second sections 40 and 42, it is to be understood that they can also be provided on center section 38. In addition, legs 52 can have any variety of shapes, and can extend and retract from the sections of the base member 32 in any conventional manner. For example, the legs 52 can have a half-moon shape and rotate, like the blade of a switch-blade knife, between the retracted and extended positions.

In the illustrated embodiment of the present invention, a retractable member 56 is also provided at the outer end of the first section 40. The retractable member 56 serves as a handle during transportation and as a support leg when the display system 30 is deployed. A similar handle can be provided on the outer end of the second section 42.

In one embodiment of the present invention, center section 38 includes a generally flat center panel 58 having a first end coupled to first end 44 of first section 40 and a second end coupled to first end 46 of second section 42. In this embodiment, first section 40 includes a generally flat first panel 60 coupled at first end 44 to center section 38. In addition, second section 42 includes a generally flat second panel 62 coupled at first end 46 to center section 38. In the stowed position, the center panel 58, the first panel 60, and the second panel 62 define three adjoining sides of the case. In the deployed position, the center panel 58, the first panel 60, and the second panel 62 define a floor contacting portion of the base of the display system30.

In a further embodiment of the present invention, first section 40 also includes a plurality of first edge panels 64, each of which is coupled to an edge of first panel 60, other than at first end 44 where first panel 60 is coupled to center section 38. Likewise, second section 42, in this embodiment, includes a plurality of second edge panels 66, each of which is coupled to an edge of second panel 62, other than at first end 46 where second panel 42 is coupled to center section 38. The configuration allows the free ends of the plurality of first edge panels 64 to be brought into confronting arrangement with the free ends of the plurality of second edge panel 66 when to the base member 32 is in the stowed position. As a result, an entire exposed surfaced of the storage case is defined by first edge panels 64, second edge panels 66, first panel 60, second panel 63, and center panel 58.

The present invention further completes providing edge panels 68 coupled to the edge portions of center panel 38. The edge panels 68 allow the perimeter of the base member 32 to have a uniform shape and structure to contain the elements of the display system 30 and also provide and aesthetically or visual appealing deployed base member 32. In the illustrated embodiment, for example, the base member 32 has a uniform rectangular shape that supports inflatable frame 34.

It is to be understood, however, that first edge panels 64, second edge panels 66, first panel 60, second panel 63, and center panel 58 can have any one of a variety of configurations and is not intended to be limited to the embodiments illustrated in the figures. For example, the present invention contemplates forming the outer edges of first panel 60 and second panel 63, i.e., the edges distal from center panel 58, in a triangular shape or in a half-circle. Of course, the corresponding edge panels associated with these panels could have a corresponding shape.

Display system 30 includes an inflating mechanism that provides a flow of inflating gas to inflatable frame 34. In a preferred embodiment, the inflating mechanism is a blower 70 mounted in base member 32. A conduit 72 connects the output of the blower 70 to inflatable frame 34. Power for the blower 70 can be provided by an external power supply (not shown), by a battery 74, or by a combination both techniques. It is to be understood, however, that the present invention contemplate inflating inflatable frame 34 by a manual pump (not shown), which can be readily stored within the case or the base member 32, or by any conventional method, such as an external inflation device.

In a preferred embodiment of the present invention, a control unit 76 controls the supply of power to blower 70. In its most simple form, control unit 76 is a manually actuated switch that turns the blower 70 on an off by interrupting the supply of power to the blower 70. In this embodiment, where the blower 70 runs continuously when switched on, an exhaust vent or other type of pressure relief or blow-off valve may be provided in inflatable frame 34 to prevent it from over-inflating.

The present invention also contemplates a more sophisticated form of feedback control of the operation of the blower 70 to automatically maintain frame 34 in the inflated position. In particular, the present invention contemplates providing a pressure sensor coupled to the inflatable frame 34 to detect a pressure within the frame 34 in the deployed position. A pressure signal is provided to controller 76, as indicated by arrow 78 so that the blower 70 is actuated by the controller 76 if the detected pressure falls below a predetermined level, thereby maintaining the inflatable frame 34 in the deployed position. It is to be understood that the pressure sensor can be located at the inflatable frame 34 or it can be located at or in controller 76, with a pressure monitoring tube connecting the pressure sensor to the inside of the inflatable frame 34. It is suggested that even in this embodiment, a pressure relief valve should be provided to prevent over-inflation in the event a malfunction occurs with the pressure monitoring and blower control system.

It is to be further understood that the present invention contemplates using other techniques to automatically inflate and maintain the frame 32 in the deployed position. For example, the blower 70 may be cycled on and off in a set period of time (e.g. 30 seconds out of every 5 minutes the blower 70 is on) with the system intentionally utilizing the pressure relief valve to vent the excess air above the desired pressure.

Figure 4:
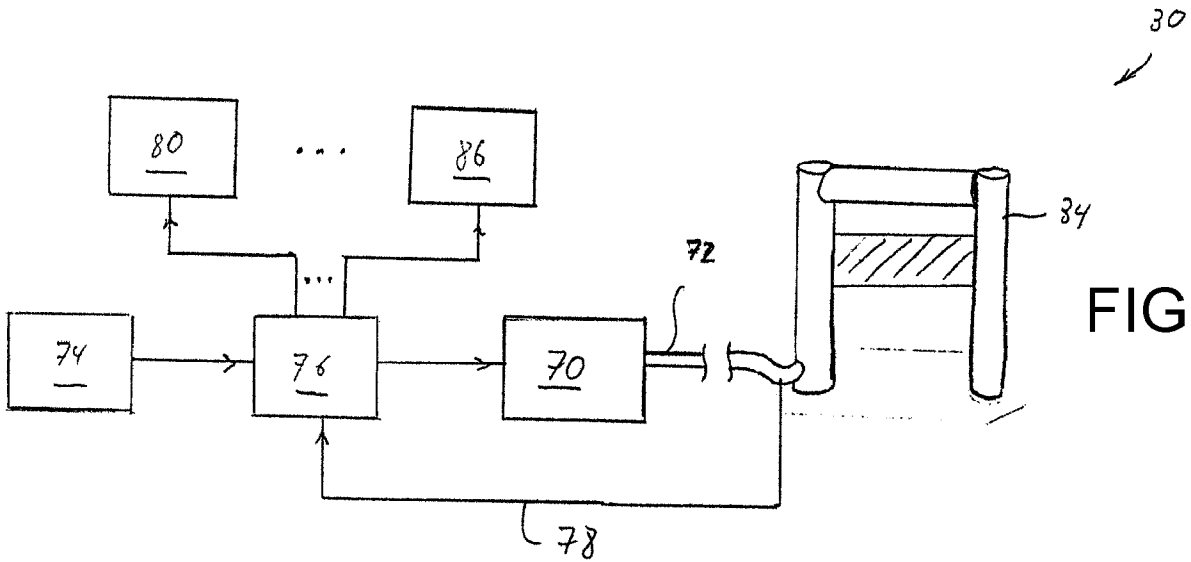
FIG. 4 is a schematic diagram of the components of the display system according to the principles of the present invention.
Figure 5:
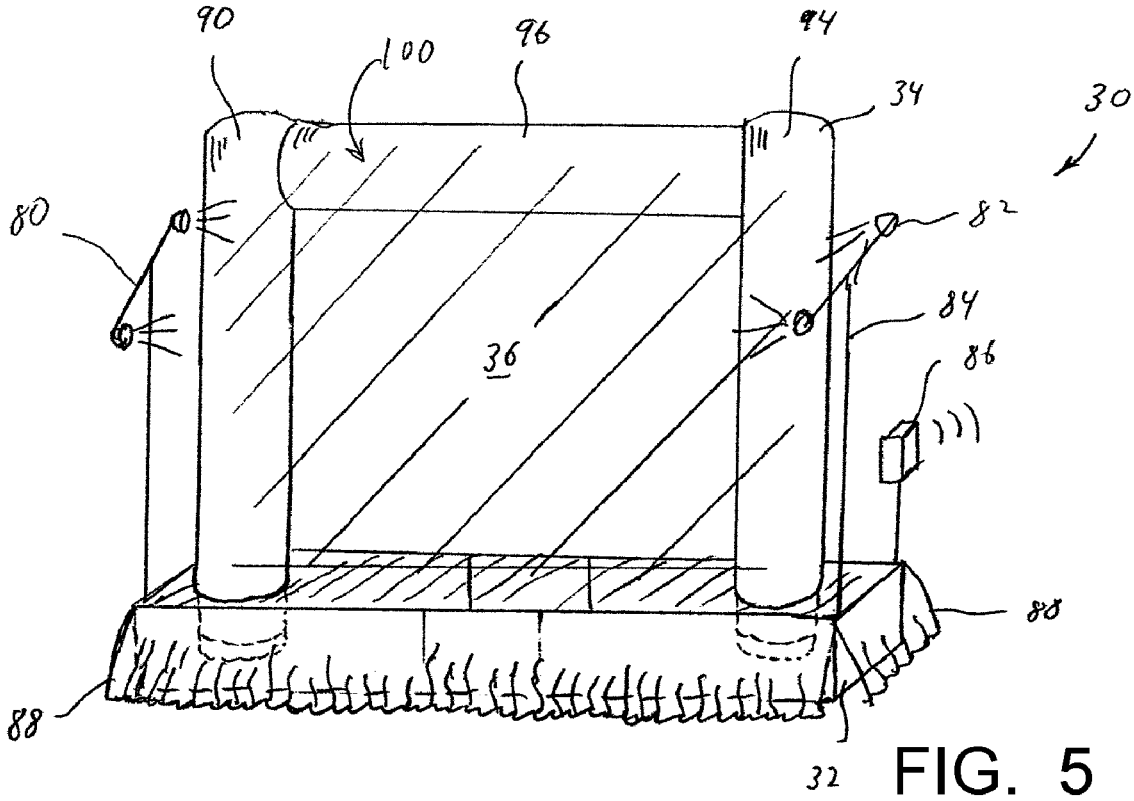
FIG. 5 is a perspective view of the display system of FIG. 1 shown in the fully deployed position.

An advantageous feature of the present invention is that a multitude of components and accessories associated with the display system 30 can be stored in base member 32 and also mounted to the base member 32 in the deployed position. For example, a lighting system 80 can be stored in the base member 32 when in the stowed position and then coupled to the base member 32 in the deployed position as shown in FIGS. 4 and 5. Of course, pockets or other attaching devices can be provided within the base member 32 for storing the lights, poles, wires, spare bulbs, etc., within the base member 32. In the illustrated embodiment, lighting system 80 includes lights 82 mounted on light poles 84. Power for the lighting system 80 can be provided by the same power source that provides power to the blower 70. FIGS. 4 and 5 also illustrate how an audio system 86 could be provided in conjunction with the base member 32. More specifically, the electronic components of the audio system, such as the CD or tape player, receiver, equalizer, and/or amplifier can be stored in base member 32, while the speakers are provided at a location outside the base member 32. This configuration allows the relatively unsightly electronics to remain hidden from casual view within the base member 32 while the speaker can be located outside the base member 32 to maximize the audio broadcast. Of course, space permitting, the speakers can also be provided within the base member 32.

One embodiment of the present invention contemplates providing a skirt 88 around the perimeter of the deployed base member 32 and shown in FIG. 5. Skirt 88 hides the potentially unsightly exposed surfaces of the panels forming the base member 32. In this embodiment, one end of the skirt 88 is attached to an inside surface of each side panel. To deploy the skirt 88, one need only flip the free ends of the skirt 88 outside the edge panels. Of course, the skirt 88 can be completely detachable from the base member 32 for cleaning purposes, for example, and attached when desired.

As noted above, inflatable frame 34 is attached to base member 32. Inflatable frame 34 includes a first frame member 90 having a first end coupled to the first section 40 of the base member 42 and a second end. In an exemplary embodiment of the present invention a coupling member 92, which is a bowl-like member, attaches the first frame member 90 to first section 40. The inflatable frame 34 also includes a second frame member 94 having a first end coupled to second section 42 of base member 32 and a second end. The first end of second frame member 94 is attached to second section 42 using the same type of coupling member 92.

Figure 7:
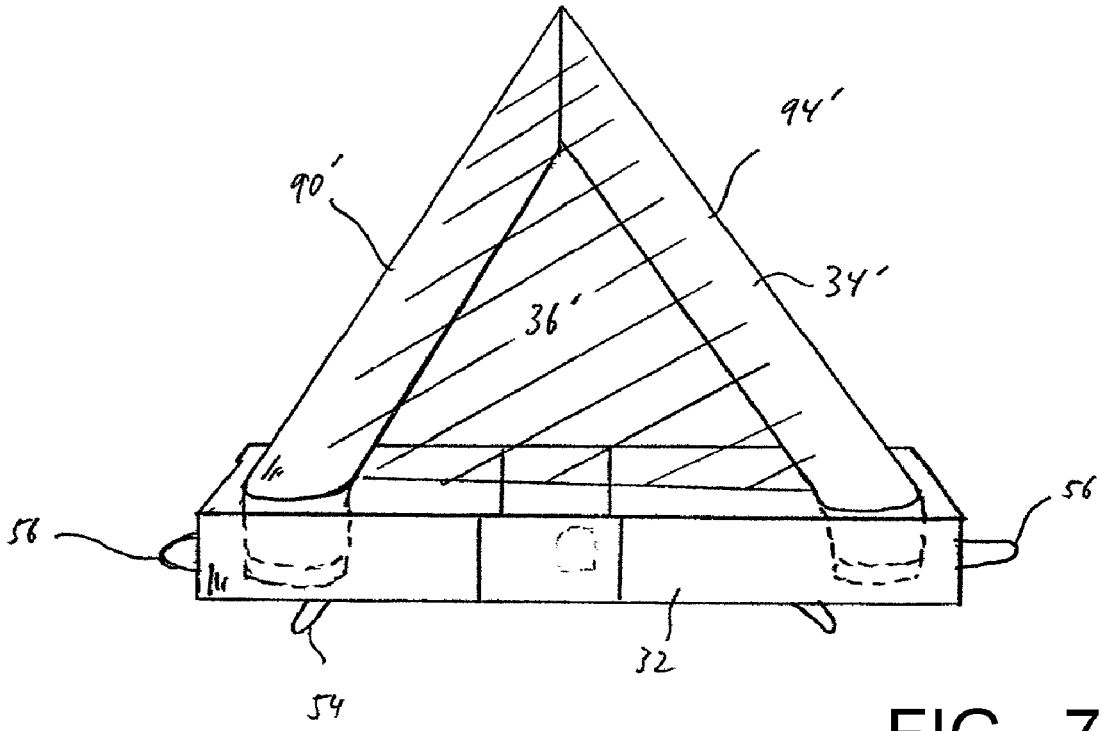
FIG. 7 is a perspective view of a display system, shown in the fully deployed position, according to a further embodiment of the present invention.

In the embodiment illustrated in FIG. 5, a third frame member 96 is disposed between the second end of first frame member 90 and the second end of second frame member 94. This configuration provides a generally square or rectangular shape for display area 36. FIG. 7, however, illustrates an embodiment of inflatable frame 34' in which the second ends of first frame member 90' and second frame member 92' are coupled directly to one another. This embodiment provides a generally triangular shape for display area 36' as shown.

Figure 6A:
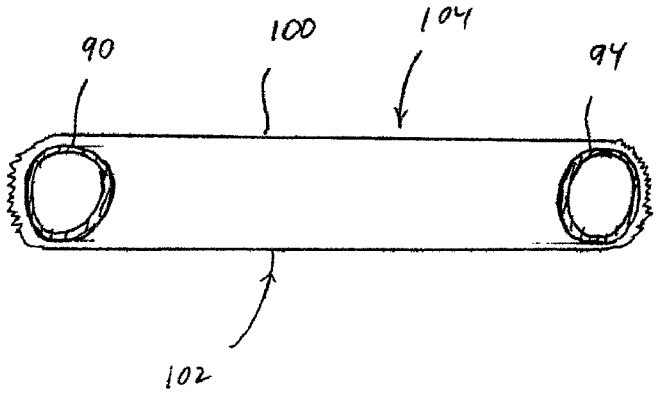
FIGS. 6A and 6B are cross-sectional views illustrating two exemplary embodiments for attaching a display screen to the inflatable frame of the display system.
Figure 6B:
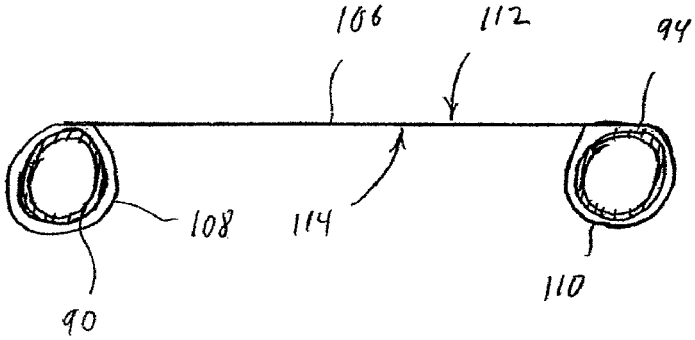

Referring again to FIG. 5 and in addition to FIGS. 6A and 6B, the present invention contemplates providing a display screen 100 that selectively couples to the inflatable frame 34 so that the screen 100 defines the display area 36. This arrangement allows the display screen 100 to be removed or replaced so that different types of screens can be used on a common frame, frame 34, and so that cleaning and maintenance of the display screens 100 can be easily performed, for example.

Display screen 100 can be coupled to the inflatable frame 34 in any conventional manner. In the embodiment shown in FIG. 6A, for example, the entire display screen 100 fits over, at least, the first and second frame members 90 and 94 in a sleeve-like fashion so that the whole display screen 100 encircles both the first and second frame members 90 and 94. This configuration provides first and second surfaces 102 and 104 on display screen 100. Both of these surfaces 102 and 104 are relatively flush with each side of the outer edges of first and second frame members 90 and 94. Preferably, display screen 100 is sized so as to be slightly less than the distance between the first and second frame members 90 and 94 so that the first and second frame members 90 and 94 impart an outward force on the display screen 100 to maintain tension on the screen 100. This tension keeps each surface 102 and 104 of display screen 100 relatively flat.

FIG. 6B illustrates a second embodiment for a display screen 106 coupled to first and second frame members 90 and 94. In this embodiment, each end 108 and 110 of the display screen 106 wraps around first and second frame members 90 and 94 in a sleeve-like fashion, thereby attaching the display screen to the inflatable frame 34. Detaching display screen 106 can be accomplished by un-wrapping the ends 108 and 110 of the display screen 106 from the associated frame member 90 and 94. Display screen 106 provides first and second surfaces 112 and 114. However, only first surface 112 is relatively flush with outer edges of first and second frame members 90 and 94. As with the embodiment shown in FIG. 6A, the distance between ends 108 and 110 is slightly less than the distance between first and second frame members 90 and 94 to maintain tension on display screen 106 in use.

Display area 36 or 36' can be used in any conventional manner known to those skilled in the art. For example, screen 100 or 106 can serve as a projection screen, or as a surface on which advertisements, information, graphics, or any other display items are mounted. The present invention provides an advantage in that the poster-boards, pictures, graphics, advertisements, or other literature can be mounted on and easily removed from the display area 36 or 36'. When not being used, these items can be conveniently stored in the base member 32. Of course, pockets, straps, or other fastening systems can be provided within the base member 32 for storing such items. The present invention contemplates attaching such items to the display area 36 or 36' in any conventional manner, for example, by means of hoop and loop fasteners provided on the surface of the display area 36 or 36' and on the surface of the display item (use of flexible material or silk screening may allow the graphics to remain in place when booth is deflated and inflated reducing time in setting booth up and putting it away.

Figure 11:
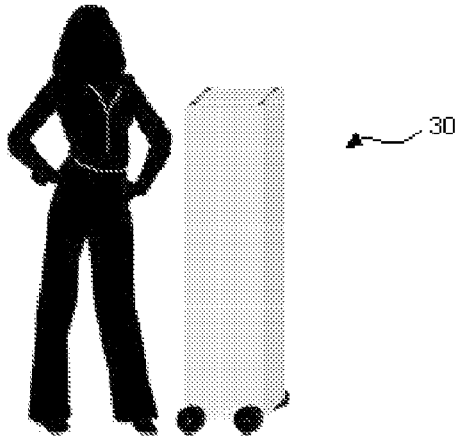
FIG. 11 is a schematic view of the display system of the present invention shown in the fully stowed position with an outline of a person for relative scale.
Figure 12:
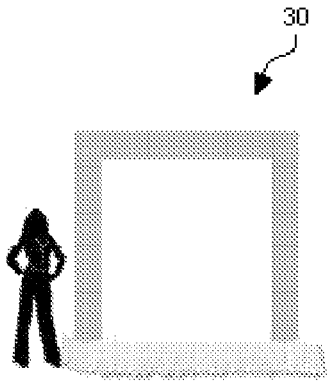
FIGS. 12-14 schematically illustrate various specific shaped embodiments of the display system of the present invention shown in the fully deployed position.
Figure 13:
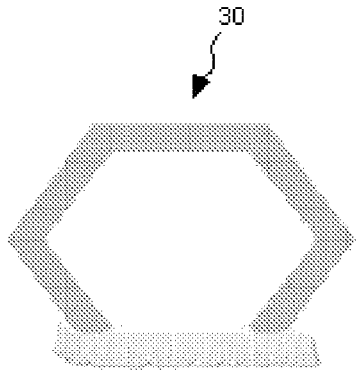
Figure 14:
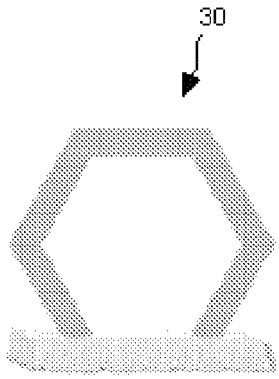

It can be appreciated that the display area 36 and 36' illustrated in the figures and described above represents only a fraction of the numerous different possible configurations for a display area 36 and 36' that can be provided by the inflatable frame 34. For example, display area 36 need not be a flat, planar surface. On the contrary, the area between the frame members 90, 94 and 96 can remain open, for example, so that an object can be suspended in this area. In addition, the display screen 100 or 106 can be permanently affixed to the frame members 90 and 94. FIG. 11 illustrates the system in a stored position with an operator shown for scale. FIGS. 12-14 further illustrate the fully deployed configurations of three separate embodiments that are shown as representative examples. Other final shapes and deployed configurations are possible as deemed useful.

An example of the method by which display system 30 is deployed and stowed is discussed below, again with reference to FIGS. 1-3 and 5. To deploy the display system 30 the user preferably positions the closed case, an example of which is shown in FIG. 1, at the location where the display system 30 is to be erected. Of course, the display system 30 can be moved once erected, but this cannot be done at the same ease as is possible when the display system 30 is in the stowed position. Next, the user unlocks or otherwise disengages first section 40 from second section 42. Then, first section 40 and second section 42 are moved apart from one other by rotating each section 40 and 42 relative to center section 38. See FIG. 2. This places the base member 32 in the deployed position, as shown in FIG. 3, while inflatable frame 34 remains collapsed and contained therein.

Inflatable frame 34 is deployed by inflating it, preferably using a blower 70 mounted in the base member 32. Inflating the frame 34 fills the frame members 90, 94 and 96 so that they extend from the base member 32. If desired, retractable legs 54 are extended from the base member 32. Once inflatable frame 34 is in the deployed position, the display media are attached to the display area 36. If desired, the accessories, such as lighting 80, video and/or audio systems 86, are erected to complete the display.

In a preferred embodiment of the present invention, a pressure sensor monitors the pressure within inflatable frame 34 and provides this information to a controller 76 in a feedback fashion. The controller 76 automatically actuates the blower 70 to maintain the inflatable frame 34 in a deployed position. Of course, the inflatable frame 34 can be manually inflated and deflated to maintain the frame 34 in the proper or desired position.

It can be appreciated from the above description, that the process required to deploy the display system 30 is very simple. Therefore, it does not require complicated instructions. It is also very quickly, so that set up of the display system 30 can be done without the need for an exhibitor to arrive a day early just to set up their display, for example. Furthermore, the deployment process requires very little physical effort on the part of the user, so that relatively frail or undersized people can easily use this display system 30.

Stowing display system 30 also has these advantages. The first step in stowing the display system 30 is to deflate inflatable frame 34 so that the inflatable frame 34 collapses into a size suitable for storage in the case. Of course, any display screen or media to be removed from the frame 34 should preferably be removed before the frame 34 is deflated. Once deflated or during deflation, the inflatable frame 34 is packed into the storage area defined by the deployed base member 32. Any accessory items or display media, if desired, can also be stored in the base member 32.

The base member 32 is then stowed by moving first section 40 and second section 42 and locking these elements together, as shown in FIG. 1 to define the case in which is contained the inflatable frame 34. Once closed, the case is suitable for transportation. Preferably, the case, in the closed position, has a size suitable for shipment using conventional shipment criteria and standards, thereby avoiding the need to pay special freight charges to transport the case.

Figure 8:
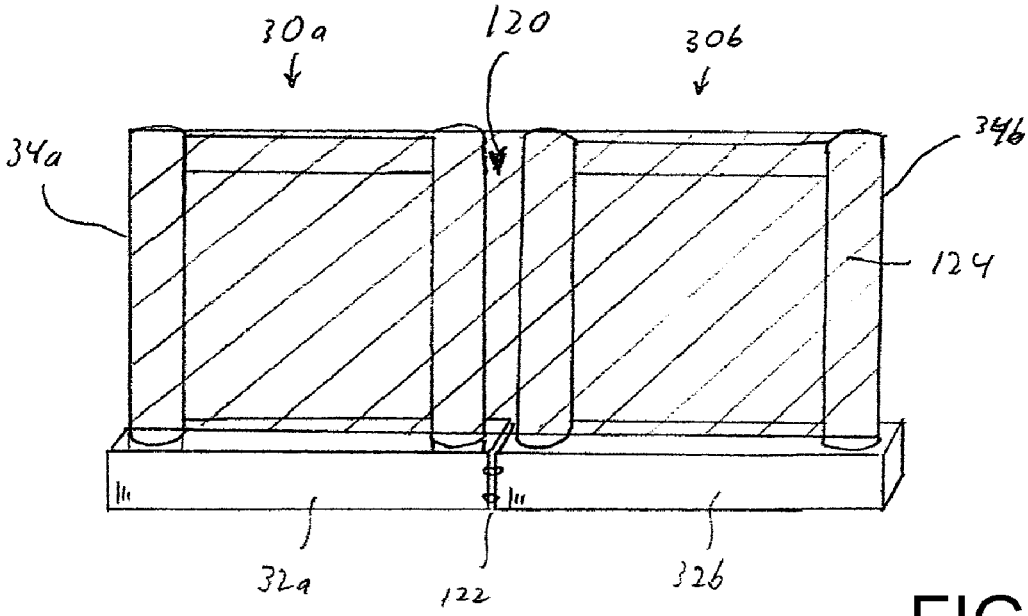
FIG. 8 is a perspective view of the display system, shown in the fully deployed position, according to a still further embodiment of the present invention.

A further embodiment of the display system according to the principles of the present invention is shown in FIG. 8. This embodiment illustrates how two display systems 30*a* and 30*b* can be combined to form a large, combined display area, generally indicated at 120. Preferably, the base members 32*a* and 32*b* of each display system are coupled together at joint 122 by any conventional fastening technique. The present invention also contemplates providing a single display screen 124 that attaches to inflatable frames 34*a* and 34*b* of each display system 30*a* and 30*b*. However, the present invention is not intended to be limited to such a configuration. Those skilled in the art will appreciate that a variety of display configurations are possible when two or more display systems 30 are combined to form an enlarged display.

Furthermore, the number of display systems 30 that can be combined, and the manner in which they are combined need not be limited to that shown in FIG. 8. For example, the present invent invention contemplates the following exemplary display system combinations: (1) combing two display systems 30 in a "T" pattern or an "L" pattern, (2) combining three display systems 30 in a triangle pattern, an "H" pattern, a "C" or a "U" pattern, and (3) combining four display systems 30 in an "X" pattern, a box pattern, and so on. The number and shape for the combination of display systems30 is only limited by the size of the area in which they located and the imagination of the user and are too numerous to attempt to describe presently.

Figure 9:
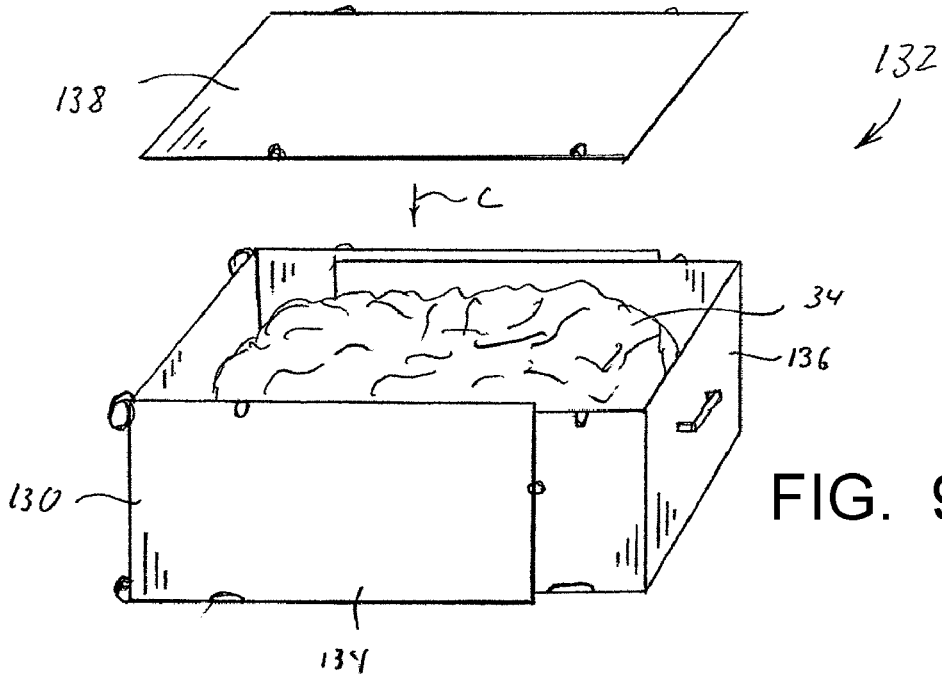
FIG. 9 is a perspective view of another embodiment for the base member shown in the stowed position.
Figure 10:
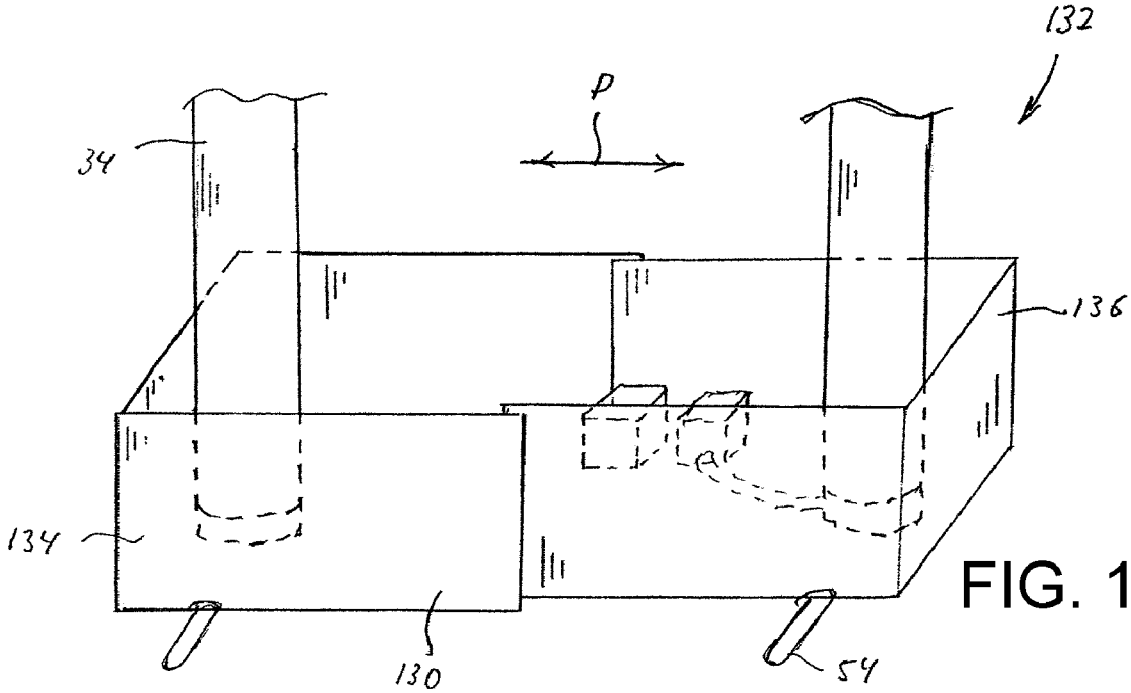

FIGS. 9 and 10 illustrate another embodiment for a base member 130 suitable for use in a display system 132 according to the principles of the present invention. FIG. 9 illustrates the base member 130 in a partially stowed position, and FIG. 10 illustrates base member 130 in its fully deployed position with inflatable frame 34 extending there from. Base member 130 is generally similar to base member 32, except that the center section has been eliminated. In all other respects, such as the ability to store the inflatable frame 34, blower 70, power supply, and controller 76, and any other accessories and to have the items coupled to the base member 130 when the display system 132 is deployed, base member 130 is the same as base member 32.

Base member 130 includes a first section 134 and a second section 136 that are movable relative to one another. More specifically, at least a portion of second section 136 slides into and in an overlapping relation with respect to first section 134 in the stowed position to form a major portion of the case, as shown in FIG. 9. The remainder of the case is formed from a cover panel 138 that attaches to the exposed edges of the first section and second section 134 and 136 in any conventional manner, as indicted by arrow C. To move base section 130 to the deployed position, first section 134 and second section 136 slide away from one another, as indicated by arrow D, to form the base for the display system 132. Preferably, the base member 130 includes a stopper to prevent the first and second sections 134 and 136 from detaching from one another entirely.

The system 30 as described herein provides the first truly integrated booth system allowing even the most petite sales person to easily carry and set up. After a tradeshow, or the like, the operator (e.g. the sales person) will disassemble the system 30 quickly and the system 30 can be removed almost effortlessly.

The sleeve system for the display area described above allows for the use of transparencies, back lighting, multiple structure shapes, and easy maintenance. If a Velcro surface with a print graphics display is more suitable for a desired presentation, the changeover is simple and inexpensive.

The system 30 as described is designed to allow the user, generally a company's sales person, to arrive less than fifteen minutes before a show opens, set up the system 30 with lights and graphics, prepare any associated power equipment, plug in computers and monitors, layout brochures and be prepared to take orders without even breaking into a sweat. The interchangeable covers also accommodate projection graphics' internally lit surfaces. It is an object of the present invention to allow an individual salesperson to setup a uniquely attractive booth and start selling and/or displaying as quickly as possible. No precious sales time is lost during setup or tear down allowing the salesperson to also leave in a timely fashion. Such savings can reduce travel costs as it becomes more practical to arrive and leave on the same day as the opening and closing of a show. In typical systems 30, such as shown in FIGS. 11-14, the system 30 is stowed in about a 36×14×24 inch case with built-in wheels and handle which expands into an 8×8 foot display area. The total booth weight of such a typical system, including the case, is about 40 pounds. Different color combinations are available on the front and back, such that a user may have an 8×8 foot graphics surface on one side and a "Velcro friendly" surface on the back (as one example), allowing for maximum flexibility.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims and equivalents thereto.

What is claimed is:

1. A display system comprising:

A) a base member comprising a plurality of sections that are moveable relative to one another between a stowed position and a deployed position, wherein the plurality of sections define a case in the stowed position, and wherein the plurality of sections define a base for the display system in the deployed position, wherein the polarity of sections of the base member include:

i) a center section;

ii)a first section having a first end rotateably coupled to a first side of the center section; and iii) a second section having a first end rotateably coupled to a second side of the center section opposite the first side, wherein the first section and the second section are complementary in size and shape such that in the stowed position the first section and the second section define opposing halves of the case; and B) an inflatable frame operatively coupled to the base member, wherein the inflatable frame is collapsible to a stowed position so as to be entirely contained in the case and inflatable to a deployed position so as to extend from the base to provide a display area for the display system wherein the inflatable frame includes:

i) a first frame member having a first end coupled to the first section of the base member and a second end, and ii)a second frame member having a first end coupled to the second section of the base member and a second end, and wherein the second end of the first frame member is coupled to the second end of the second frame member.

2. The display system of claim 1, further comprising a third frame member disposed between the second end of the first frame member and the second end of the second frame member.

3. The display system of claim 1, further comprising inflating means for providing a flow of inflating gas to the inflatable frame.

4. The display system of claim 3, wherein the inflating means comprises a blower disposed on the base member and coupled to the inflatable frame, wherein the blower is adapted to provide a flow of inflating gas to the inflatable frame, and wherein the blower is disposed on the base member such that the blower is contained within the case in the stowed position and is disposed in the base in the deployed position.

5. The display system of claim 4, further comprising:

a pressure sensor operatively coupled to the inflatable frame and adapted to detect a pressure within the inflatable frame; and a controller coupled to the blower and the pressure sensor, wherein the controller receives an output of the pressure sensor and actuates the blower based on the output to maintain the inflatable frame in the deployed position.

6. The display system of claim 1 further comprising a lighting system adapted to be coupled to the base member in the deployed position and to be stored within the case in the stowed position.

7. The display system of claim 1 wherein the base member includes a least one retractable leg adapted to extend from at least one of the plurality of sections of the base member.

8. The display system of claim 1, further comprising a display screen adapted to be coupled to the inflatable frame so that the screen defines the display area.

9. The display system of claim 1, wherein the center section comprises a generally flat center panel having a first end and a second end, wherein the first section comprises a generally flat first panel having a first end coupled to the first end of the center section and a second end, wherein the second section comprises a generally flat second panel having a first end coupled to the second end of the center section and a second end, wherein, in the stowed position, the center panel, the first panel, and the second panel define three adjoining sides of the case, and wherein, in the deployed position, the center panel, the first panel, and the second panel define a floor contacting portion of the base of the display system.

10. The display system of claim 9, wherein the first section further comprises a plurality of first edge panels, each first edge panel being coupled to an edge of the first section other than at the first end, wherein the second section further comprises a plurality of second edge panels, each second edge panel being coupled to an edge portion of the second section other than at the first end, and wherein a free end of the plurality of first edge panels are arranged in a confronting arrangement with a free end of the plurality of second edge panel responsive to the base member being in the stowed position such an entire exposed surfaced of the case is defined by the plurality of first edge panels, the plurality of second edge panels, the first panel, the second panel, and the center panel.

* * * * *